United States Patent [19]

Snell

[11] 4,285,225

[45] Aug. 25, 1981

[54] TOOL FOR INSTALLATION OF TOGGLE-SCREW ANCHORS

[76] Inventor: John H. Snell, 1325 Gateway Dr., Lantana, Fla. 33462

[21] Appl. No.: 101,112

[22] Filed: Dec. 7, 1979

[51] Int. Cl.[3] ..... B21J 15/38

[52] U.S. Cl. ..... 72/114; 72/391; 72/454

[58] Field of Search ..... 72/114, 391, 454; 85/70, 71; 29/243.5, 243.54, 243.53

[56] References Cited

U.S. PATENT DOCUMENTS

| | | | |
|---|---|---|---|
| 1,102,937 | 7/1914 | Malaby | 72/391 |
| 2,428,458 | 10/1947 | Hollwarth | 72/391 |
| 3,587,271 | 6/1971 | Rigot | 72/114 |
| 4,038,851 | 8/1977 | Coloma | 72/114 |
| 4,086,799 | 5/1978 | Brendle | 72/114 |

*Primary Examiner*—Nicholas P. Godici
*Assistant Examiner*—Gene P. Crosby
*Attorney, Agent, or Firm*—Maky, Renner, Otto & Boisselle

[57] ABSTRACT

A tool for toggle-screw anchors in which the anchor sleeve has flanged and threaded ends and an intermediate longitudinally slotted section which collapses radially outwardly (to grip the rear side of a wall while the flanged end is engaged with the front side of the wall) upon movement of the threaded end toward the flanged end, the tool herein being characterized in the provision an elongated body of strip material having a narrow end bent to form a handle and having a wide end with an opening therethrough through which the shank of a hex head actuating screw extends for clamping said wide end between the flange of an anchor sleeve screwed onto said actuating screw and a spacer washer (s) of selected thickness between the head of the actuating screw and the wide end of the body. With the flange of the anchor sleeve thus snugly engaged with the wide end of the body, the anchor sleeve is pushed through an opening in a wall until the flange and side face of the elongated body is against the front side of the wall. The handle may be gripped between the forefinger and thumb of one hand to hold the body against the wall and against turning while a wrench engaged with the head of the actuating screw is turned to cause drawing of the threaded end of the anchor sleeve toward the flanged end thus to radially outwardly collapse the intermediate longitudinally slotted section of the anchor sleeve to grip the rear side of the wall while the flanged end is engaged with the front side of the wall.

9 Claims, 5 Drawing Figures

TOOL FOR INSTALLATION OF TOGGLE-SCREW ANCHORS

BACKGROUND OF THE INVENTION

Interior walls of office buildings, homes, apartments, etc., are usually of so-called drywall construction which has poor nail and screw holding power except at the location of the studs. A common form of hollow wall anchor is the toggle-screw anchor, e.g. MOLLY brand screw anchor. In the installation of such screw anchor, a hole is drilled through the wall and the anchor is pushed through the hole with its flange engaging the front side of the wall and generally the screw head of the anchor is tapped with a hammer to embed the spurs of tangs of the flange of the anchor sleeve into the wall. Thereafter the screw is turned with a screwdriver under considerable torque and axial pressure to initiate drawing of the threaded end of the anchor sleeve toward the flanged end to cause collapsing of the intermediate section of the anchor sleeve into gripping engagement with the rear side of the wall. Occasionally the large forces applied by the screwdriver may cause the flanged end of the anchor sleeve to be pushed through the wall especially if the hole in the wall is oversize. Moreover, if the hole in the wall is not perpendicular to the wall the screwdriver is ineffective to correctly position the collapsed anchor sleeve perpendicular to the wall.

Known tools for installation of toggle-screw anchors as disclosed for example in the U.S. Pat. Nos. to Hollwarth 2,428,458 and Coloma 4,038,851 are of complex and expensive construction and operate on the principle of pivoted toggle levers which are operative to axially draw the threaded end of the anchor sleeve toward the flanged end for collapsing the same. In these constructions the levers are spread apart in use and hence are not suitable for installation of toggle-screw anchors in close quarters as in the corner of a room, near the ceiling or floor.

In my copending application Ser. No. 971,346, filed Dec. 20, 1978, now U.S. Pat. No. 4,201,072, the tool for installation of toggle-screw anchors includes an L-shaped body of injection molded plastic material having an elongated tubular leg for the anchor sleeve collapsing screw and an elongated radially extending leg which is perpendicular to the tubular leg and has a planar wall-engaging surface flush with the inner end of the tubular leg. The anchor sleeve collapsing screw has a head adjacent to the outer end of the tubular leg with wrench-engaging flats or with a cross bar by means of which high torque may be applied on the screw for causing collapse of the anchor sleeve without imposing push-through axial pressure on the flange of the anchor sleeve and while holding the actuating screw and anchor sleeve perpendicular to the wall by holding the radially extending leg against the wall and against turning.

SUMMARY OF THE INVENTION

In contradistinction to the tool disclosed in said Ser. No. 971,346, now U.S. Pat. No. 4,201,072, the tool constituting the present invention is of yet simpler, lighter weight and less expensive construction in that the body of the tool is an elongated, flat strip which is of tapered width from narrow width at one end to wide width at the other end (wider than the flange of the anchor sleeve), the narrow end being transversely bent to form a handle and the wide end having an opening through which an anchor sleeve collapsing screw extends for clamping of the wide end between the flange of the anchor sleeve and a spacer washer between the wide end of the body and the head of the anchor collapsing screw. The tool herein accommodates different sizes of anchor sleeves and a simple, inexpensive form of wrench is provided stamped from strip stock to accommodate the different hex sizes on the different size anchor sleeve collapsing screws.

Other objects and advantages will appear from the ensuing description.

DETAILED DESCRIPTION OF THE PREFERRED EMBODIMENT

Figure 3:
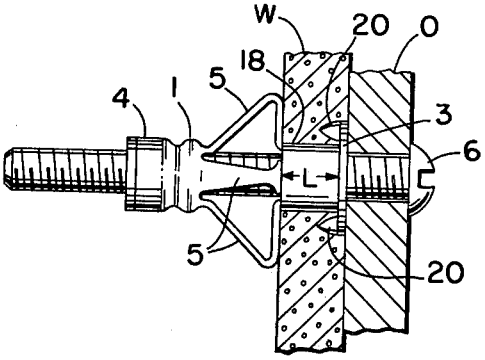
FIG. 3 is a cross-section view showing the collapsed screw anchor in use in supporting a load on the front side of the wall.

The toggle-screw anchor sleeve 1 with which the present tool 2 is adapted to be used comprises flanged and threaded ends 3 and 4 and an intermediate longitudinally slotted section which leaves partially prebent strips 5 which are bent and spread apart when the threaded end 4 of the sleeve 1 is drawn axially toward the flanged end 3. The deformed condition of the anchor sleeve 1 is shown in FIG. 3 which also shows the anchor screw 6 in place holding an object O against the wall W. The wall W herein shown by way of example is a drywall panel which comprises a plasterlike material between layers of paper on opposite sides and which is nailed or screwed to wall studs in well known manner.

As well known, toggle-screw anchors (sleeves 1 and screws 6) are available in numerous sizes for example Nos. 6–32, 10–24, and $\frac{1}{4}''$–20 and in various grip lengths L from about $\frac{1}{8}''$ to well over 1″ for installation in walls or other objects of different thicknesses.

Figure 1:
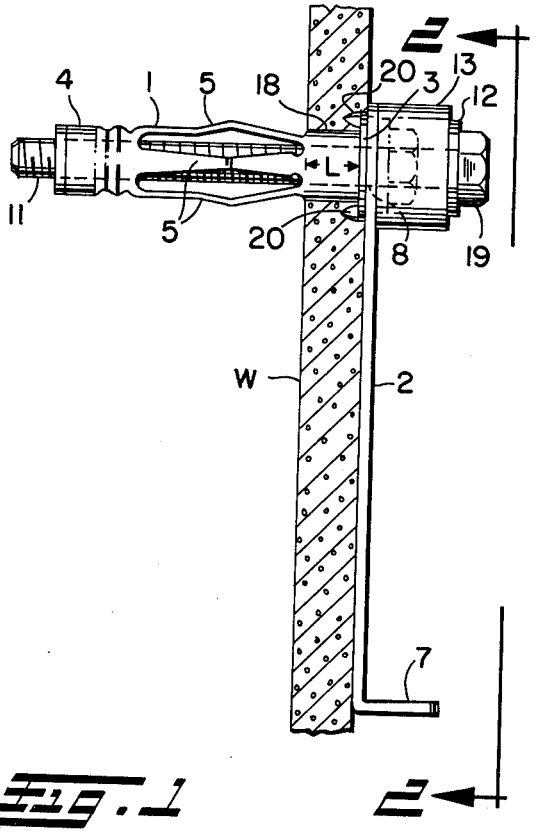
FIG. 1 is a side elevation view showing a preferred form of tool ready to effect setting of the sleeve of a toggle-screw anchor to grip the rear side of a hollow wall while the flange of the anchor sleeve is engaged with the front side of the wall.
Figure 2:
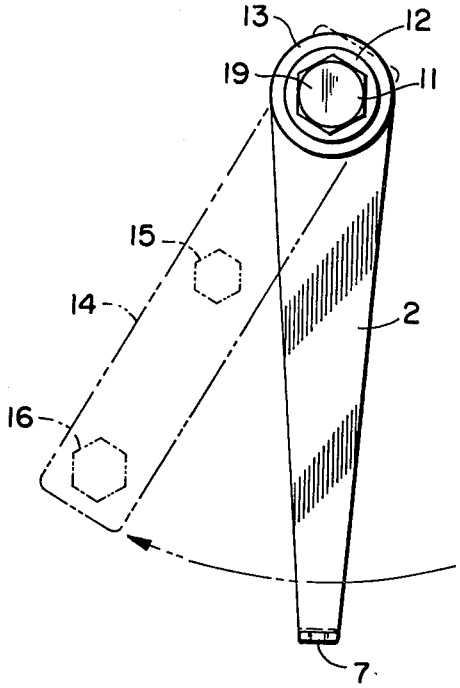
FIG. 2 is an end elevation view as viewed along the line 2—2 of FIG. 1.

As shown in FIGS. 1 and 2 (also FIG. 4), the tool 2 comprises a flat, elongated strip of rigid material such as 1/16″ thick aluminum, the strip being of tapering width, the narrow end being transversely bent to form a handle 7 and the wide end being rounded on a diameter greater than the flange 3 diameter of the largest one of the sizes of anchors above mentioned. The wide end of the tool 2 has an opening 8 therethrough which, in the case of a tool 2 for use with the sizes of anchors previously mentioned, would be of diameter slightly greater than $\frac{1}{4}''$.

Figure 4:
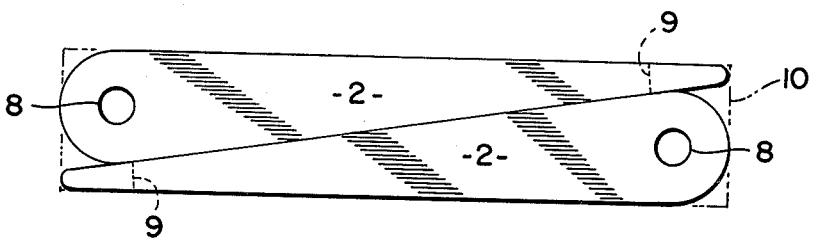
FIG. 4 is a plan view of a blank of strip material from which two elongated tool bodies may be made with but little scrap.

By way of example, the wide end of the tool 2 may be of $\frac{3}{4}''$ width and the narrow end at approximately the bend line 9 is $\frac{1}{4}''$ whereby a $1'' \times 4\frac{1}{2}''$ blank 10 of 1/16″ thickness may be employed to make two tools 2 as shown in FIG. 4 with but very little scrap. The handle 7 is preferably about ½" length whereby the full length of the tool 2 is about 4".

For 6–32, 10–24 and ¼"–20 anchor sleeves 1, the anchor sleeve collapsing screws 11 are inexpensive standard hex head screws each having a standard washer 12 and each having a length to accommodate an anchor sleeve 1 of greatest grip length L. To minimize the length of screw 11 which projects beyond the threaded end 4 of the anchor sleeve 1, spacer washers 13 of nylon or the like of different thicknesses, for example ½" and ¼", with an I.D. slightly greater than ¼", are provided for use individually or collectively according to the grip length L.

Figure 5:
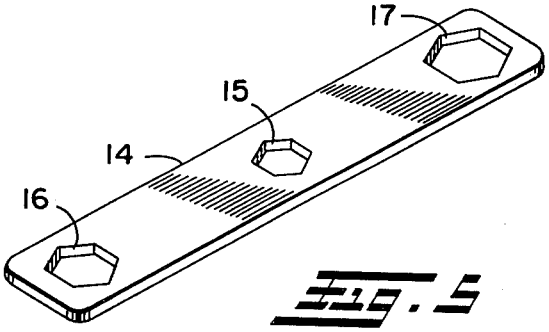
FIG. 5 is a perspective view of a wrench stamped from strip stock to provide different sizes of hex openings for use in turning anchor sleeve collapsing screws of different sizes.

For convenience, a wrench 14 as shown in FIG. 5 stamped as from 1/16" strip stock may be provided with 5/16", ⅜" and 7/16" hex openings 15, 16 and 17 corresponding to the hex heads of the respective 6–32, 10–24, and ¼"–20 actuating screws 11, the largest hex opening 17 being adjacent one end of the wrench 14 for greater leverage.

In installing an anchor sleeve 1 in wall W of a room, a hole 18 is drilled in the wall wand the anchor sleeve 1 is screwed onto the projecting end of the screw 11 until the flange 3 snugly engages the inner side face of the tool 2 whereupon the anchor sleeve 1 thus mounted on the screw 11 is pushed through the hole 18 in the wall W and the head 19 of the screw 11 may be tapped lightly with a hammer or like tool to embed the spurs or tangs 20 of the flange 3 in the wall W surrounding the drilled hole 18. In the case of drywall, such tapping usually wholly embeds the flange 3 flush with the front side of the wall W. In the event that the hole 18 is not perpendicular to the wall W tapping or pushing of the tool against the wall W will straighten the screw 11 and anchor sleeve 1 to perpendicular position. For a right-handed person, the handle 7 may be gripped between the forefinger and thumb of the left hand to hold the tool 2 against the wall W and against turning. The forefinger of the right hand may then be used to spin the wrench 14 engaged with head 19 as indicated by the arrow in FIG. 2 to cause drawing of the threaded end 4 of the anchor sleeve 1 toward the flanged end 3, the tightening being continued until the anchor sleeve 1 is expanded to grip the rear side of the wall W as shown in FIG. 3.

As aforesaid, each tool kit will be provided with actuating screws 11 of different sizes as indicated, i.e. 6–32, 10–24, and ¼"–20, and of appropriate length to handle the maximum grip length L of each size of anchor sleeve 1. In the event that wall W has an obstruction or is of depth insufficient to accommodate the length of the actuating screw 11, a spacer washer 13 as of nylon of desired thickness may be interposed between the outer surface of the wide end of the tool 2 and the head 19 of the actuating screw 11 to decrease the length of projection of the screw 11 beyond the threaded end 4 of the anchor sleeve 1. Moreover, even if there is room for the screw 11, the decreased projection thereof facilitates the screwing of the anchor sleeve 1 to engage its flange 3 with the tool 2.

For anchor sleeves 1 of greatest grip length L it may be desirable to omit the nylon spacer washer 13 and to employ the screw washer 12 as a minimum spacer washer as shown in phantom lines in FIG. 1.

In the specific example herein given, the length of the wrench 14 is such that it clears the handle 7 to facilitate quick collapsing of the anchor sleeve 1. In case the anchor sleeve 1 is collapsed by turning the actuating screw 11 with a conventional open end wrench, box wrench, crescent wrench, or the like which is longer than the tool 2, it would be preferable to use, say, the ½" spacer washer 13 so that the wrench will clear the handle 7 to permit continuous turning of the wrench 14 without changing position thereof.

The embodiments of the invention in which an exclusive property or privilege is claimed are defined as follows:

1. A tool for installation of a toggle-screw anchor of the type including an anchor sleeve having flanged and threaded ends with an intermediate longitudinally slotted section which is radially expanded upon axial movement of the threaded end toward the flanged end; said tool comprising an elongated flat body of strip material of tapered width having a handle at its narrow end projecting transversely from one side of said body and a passage through the middle of its wide end; and an actuating screw having a head and at least one spacer washer adjacent to said head; said screw having a shank extending through said washer and said passage and projecting transversely from the other side of said body for screwing thereonto an anchor sleeve with its flanged end snugly engaged with said other side of said body while said washer is snugly engaged between said head and said one side of said body whereby said projecting shank and anchor sleeve thereon may be inserted into a hole in a wall or the like with said other side of said body engaged with the front side of the wall to retain said screw, washer, and anchor sleeve perpendicular to the wall; said screw, upon turning thereof with respect to the anchor sleeve by torque applied on said head while said body is held against the wall and against turning by said handle, being operative to expand the anchor sleeve to grip the rear side of the wall around the hole.

2. The tool of claim 1 wherein said wide end is rounded and is of width greater than the diameter of the flange of the anchor sleeve.

3. The tool of claim 1 wherein said spacer washer is of predetermined thickness to predeterminedly shorten the projection of said screw from said other side of said body.

4. The tool of claim 1 wherein said head has wrench engaging flats; and wherein said spacer washer is of thickness at least as great as the transverse projection of said handle from said body.

5. The tool of claim 1 wherein said passage is of diameter large enough to accommodate the largest one of a plurality of actuating screws for different sizes of anchor sleeves but is of smaller diameter than the diameter of the flange of the smallest one of said different size anchor sleeves; wherein the inside diameter of said spacer washer is substantially the same as the diameter of said passage; and wherein each screw has another washer thereon of inside diameter substantially the same as the diameter of said shank and of outside diameter greater than the inside diameter of said spacer washer.

6. The tool of claim 5 wherein each actuating screw has a non-circular cross-section head of size commensurate with the size of said screw.

7. The tool of claim 6 wherein an elongated wrench of strip material has longitudinally spaced apart openings therethrough which are complemental with the respective non-circular cross-section heads of said different size actuating screws.

8. The tool of claim 7 wherein two of such wrench openings are adjacent the ends of said wrench.

9. The tool of claim 8 wherein said wrench is of length such that the end thereof remote from an opening engaged with a head of an actuating screw radially clears said handle.

* * * * *